United States Patent [19]

O'Brien

[11] Patent Number: 4,675,918

[45] Date of Patent: Jun. 30, 1987

[54] ONE PIECE BRIEF WITH HOOK AND PILE CLOSURES

[76] Inventor: Ann N. O'Brien, 53-16 62 St., Maspeth, N.Y. 11378

[21] Appl. No.: 923,309

[22] Filed: Oct. 27, 1986

[51] Int. Cl.[4] ..... A41B 9/04

[52] U.S. Cl. ..... 2/402; 2/408; 2/DIG. 6

[58] Field of Search ..... 2/402, 403, 406, 408, 2/DIG. 6, 238, 67

[56] References Cited

U.S. PATENT DOCUMENTS

| | | | |
|---|---|---|---|
| 2,258,502 | 10/1941 | Perez | 2/402 X |
| 2,493,113 | 1/1950 | Dance | 2/406 X |
| 3,207,155 | 9/1965 | Casey | 2/403 X |
| 3,344,438 | 10/1967 | Title | 2/402 |
| 3,496,576 | 2/1970 | Artzt | 2/402 |
| 4,145,763 | 3/1979 | Abrams et al. | 2/403 |
| 4,258,440 | 3/1981 | McGowan | 2/403 X |
| 4,597,110 | 7/1986 | Smith, Sr. et al. | 2/408 |

*Primary Examiner*—H. Hampton Hunter

*Attorney, Agent, or Firm*—McGlew and Tuttle

[57] ABSTRACT

A one-piece brief comprises an upper band portion with front and rear panels. A short tab portion depends from the center of the front panel while a longer crotch portion descends from the center of the rear panel. Fastening tapes are provided at the edges of the front and rear panels and at the lower edges of the tab and crotch portions. A resilient waist band extends along a top edge of the upper band portion and carries at one end an outwardly extending fastening tape which engages another fastening tape at an opposite end of the waist band to be used in properly aligning side edges of the front and rear panels.

10 Claims, 6 Drawing Figures

FIG. 1
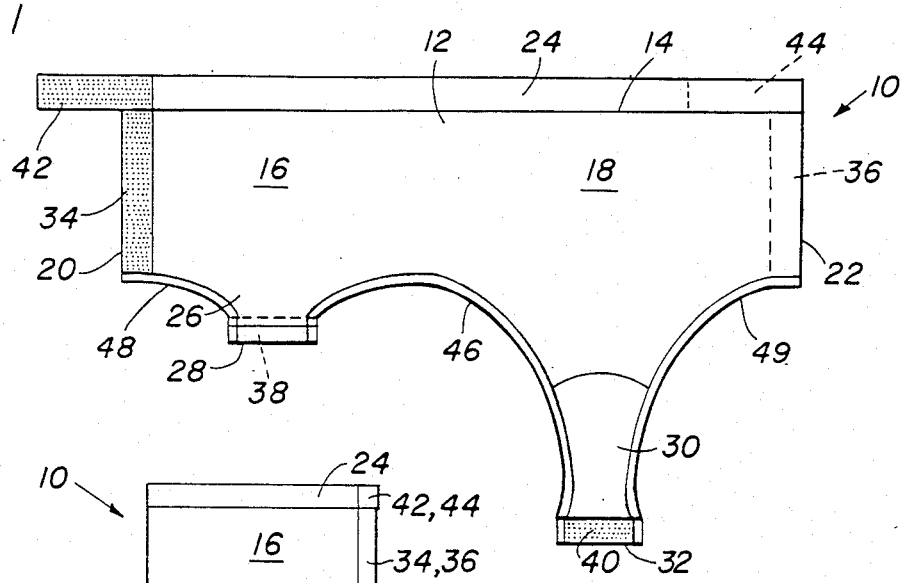
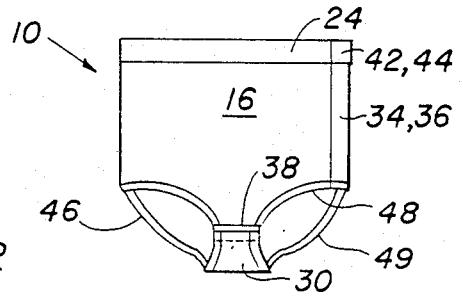
FIG. 2
FIG. 3
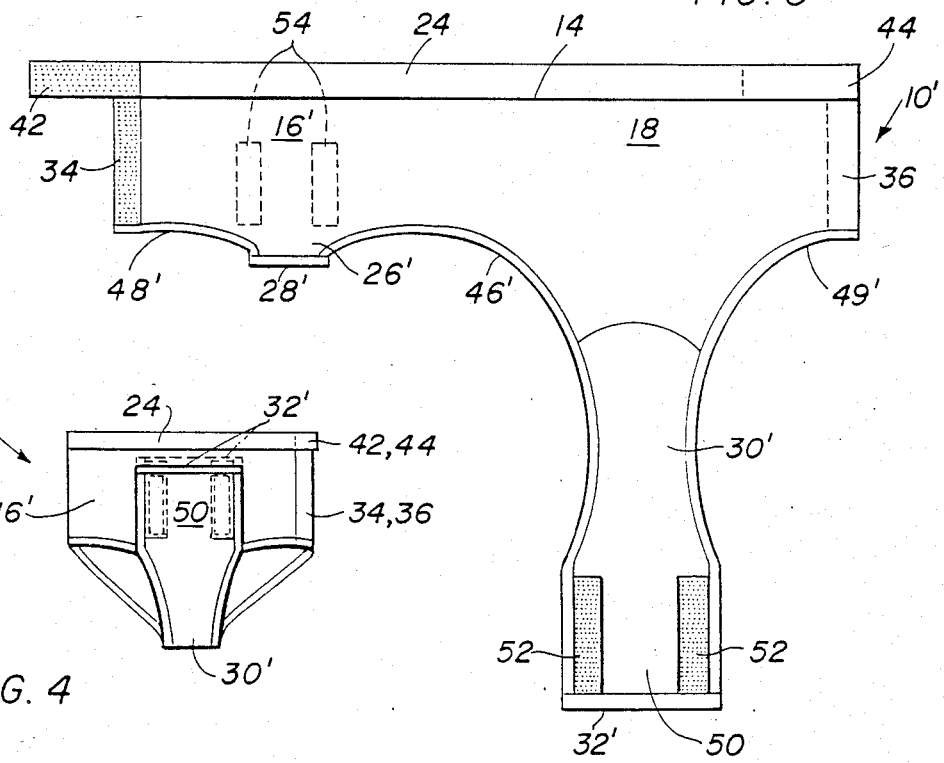
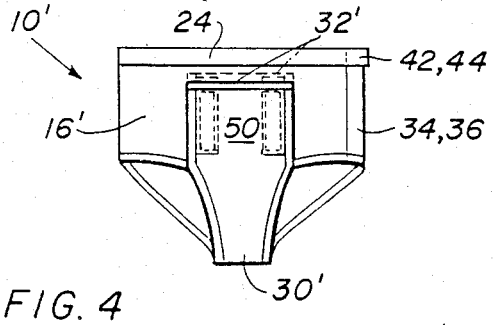
FIG. 4

FIG. 5
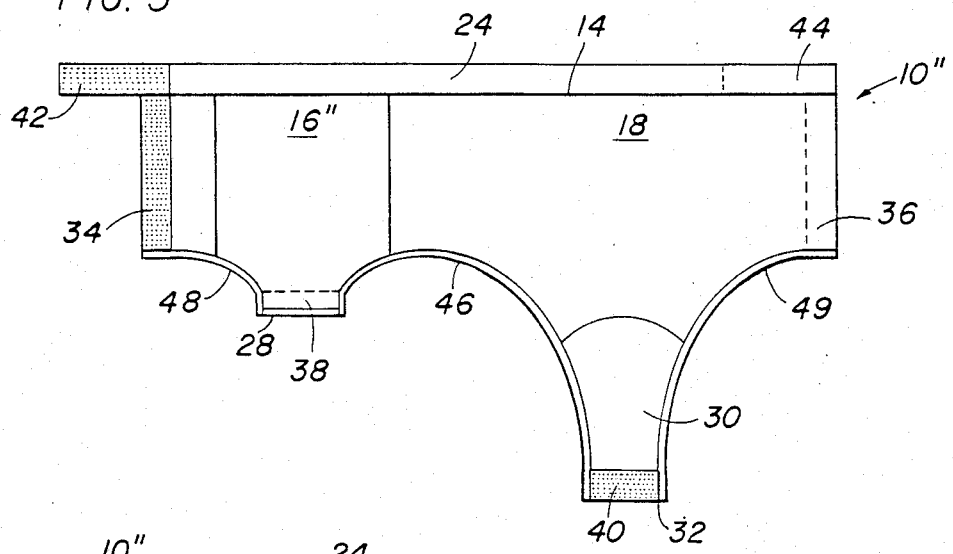
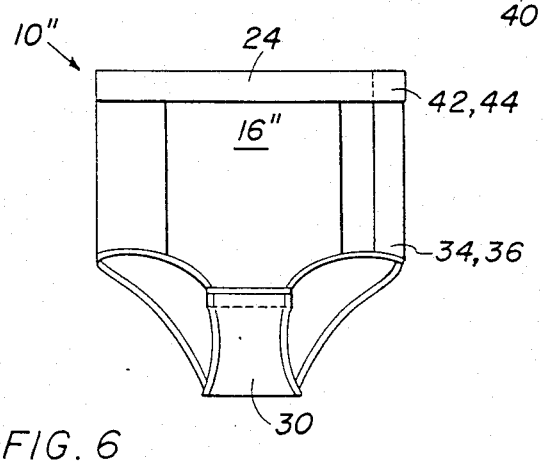
FIG. 6

ONE PIECE BRIEF WITH HOOK AND PILE CLOSURES

FIELD AND BACKGROUND OF THE INVENTION

The present invention relates in general to clothing and in particular to a new and useful brief which is particularly suited to persons having a physical disability or impairment.

For elderly people or people suffering from a permanent or temporary disability which impairs their movement, it is sometimes difficult to don and remove conventional briefs.

Particularly with people suffering from back pain or injury, it is difficult or sometimes impossible to bend sufficiently to don the conventional garment.

A garment which can be worn without requiring any bending would be particularly useful to such people.

Briefs and diaper structures are known which have detachable sides so that the garment can be donned without requiring the person to bend over in any way. One example can be found in U.S. Pat. No. 4,258,440 to McGowan which shows briefs for a handicapped person having front and rear panels which are connected at the crotch and which use hook and pile (Velcro, a trade name) fasteners. This garment still requires one of the large panels to be drawn up around the crotch area and then fastened at the sides.

An arrangement having a detachable crotch area as well as detachable sides is found in U.S. Pat. No. 4,145,763 to Abrams et al. This structure also uses hook and pile fasteners with totally detachable front and back panels. A problem with this structure is that the front and back panels must be aligned correctly before they can be attached. This may require even more maneuvering than would be used in conventional brief designs.

U.S. Pat. No. 3,486,501 to Erickson et al shows an abdominal scultetus which is fastenable at the sides by a pleurality of horizontally extending hook and pile fasteners. The complex design is particularly useful in dressings for people who have undergone surgery.

Other designs for diapers and brief structures can be found in the following patents:

U.S. Pat. No. 2,493,113 to Dance
U.S. Pat. No. 2,431,571 to Lehr
U.S. Pat. No. 2,500,432 to Ravkind et al
U.S. Pat. No. 3,207,155 to Casey
U.S. Pat. No. 4,280,230 to Lafleur.

SUMMARY OF THE INVENTION

The present invention is drawn to a structure for mens' or womens' briefs which has a crotch connected to a rear panel of the brief that can be brought up to the front panel of the brief being wrapped around the front of the person and attached to the rear panel at side edge of the front and rear panels.

This orientation of parts for the one piece brief permits an impaired person to simply lock on the rear panel of the brief and then easily bring the front panel and crotch portion to the front. A waste fastening tab which is formed as an extention of a waste band for the brief is provided to exactly align the top edge of the waste band and vertically align side fastening tapes for the edges of the front and rear panels to be brought together.

In a mens' design for the briefs, verticle hook and pile tapes are provided on the crotch portion and can meet with verticle tapes on the outside of the front panel to permit verticle adjustment of the crotch portion.

Accordingly, an object of the present invention is to provide a one-piece brief which comprises an upper band portion having front and rear panels and a crotch portion descending from the middle of the rear panel. Hook and pile fasteners are provided at side edges of the front and rear panels and a waste band is provided which has an extended fastening tape that can engage around the waste of the person enfastened with a tape on another part of the waste band. This aligns the fastening tapes at the edges of the front and rear panels. The crotch portion is also provided with fastening tapes so that it can be brought up to the front panel and fastened thereto.

A further object of the invention is to provide a one-piece brief which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings

FIG. 1 is plan of view of the inside surface of the one-piece brief of the present invention shown in an open condition;

FIG. 2 is a plan view of the one-piece brief in its folded and closed condition;

FIG. 3 is a view similar to FIG. 1 showing another embodiment of the invention particularly suited for men;

FIG. 4 is a view similar to FIG. 2 of the brief shown in FIG. 3 but in a closed condition;

FIG. 5 is a view similar to FIG. 3 of a still further embodiment of the invention which is particularly suited for pregnant women;

FIG. 6 is a view similar to FIG. 4 showing the brief of FIG. 5 in a closed and fastened condition.

DESCRIPTION OF THE PREFERRED EMBODIMENT

Referring to the drawings, the invention embodied in FIGS. 1 and 2 comprises a one-piece brief generally designated 10 having an upper band portion 12 with an upper horizontal edge 14. The upper band portion 12 has a front panel 16 and a rear panel 18 connected to the front panel 16. The front panel 16 has a first open verticle side edge 20 and the rear panel 18 has a second open verticle side edge 22. A resilient waist band 24 is connected to and extends along the upper edge 14. Resilient band 24 can be made of the elastic fabric or any other resilient material which is usually used as a waist band in briefs.

A short tab portion 26 depends from the center of the front panel 16 and has a first lower horizontal edge 28. A long crotch portion 30 depends from a center of the rear panel and has a second lower horizontal edge 2. The crotch portion 30 is longer than the tab portion 26.

Vertical lengths of fastening tape 34 and 36 are connected to the first and second vertical side edges 20 and 22 respectively. Tape 34 may be of the pile type and tape 36 may be of the hook type so that when these two tapes are brought into contact with each other they will form a fastening connection.

A first length of waist fastening tape 42 is connected to the waist band 24 and extends outwardly beyond the first edge 20. A second length of waist fastening tape 44 is connected to the opposite end of waist band 24 and has an edge which lies flush with the second edge 22.

A first length of crotch portion fastening tape 38 is connected to the edge 28 of crotch portion 26 and likewise a second length of crotch portion fastening tape 40 is connected at the lower edge 32 of crotch portion 30.

In FIG. 1, the inner surface of the brief is shown which is meant to come into contact with the wearers' skin. Tapes 36, 38 and 44 are mounted on the outside surface of the one-piece brief (these tapes being shown by dotted lines) while tapes 34, 40 and 42 are connected to the inside surfaces of the brief. Tape 42 of course extends beyond the end of waist band 24.

To don the brief shown in FIG. 1 a person merely places the brief with the rear panel behind and then wraps the front panel across the front. The first length of waist fastening tape 42 can be held and conveniently brought into contact with the second length of waist fastening tape 44. This automatically aligns the vertical fastening tapes 44 and 36 which can then be pressed together. To complete the donning process, the crotch portion 30 is brought up between the legs and tape 40 pressed onto tape 38.

In this way, the person can wear the briefs of the present invention without having to bend. A person lying on a bed can don the briefs in an equally simple manner by simply lying on the rear panel 18 and then repeating the steps set forth above.

FIG. 2 shows the assembled brief 10 from the front.

Curved lower transition edges or zones 46 separate crotch portion 26 and 30 while outer transition zones 48 and 49 form the rest of a leg engaging hole when the brief is assembled as shown in FIG. 2.

The brief of FIGS. 1 and 2 is primarily suited for women.

FIGS. 3 and 4 show a brief according to the invention which is primarily suited for men. All numerals which designate the same elements as in FIGS. 1 and 2 carry the same reference numerals. Corresponding but slightly modified elements carry the same reference numeral but with a prime.

In FIG. 3 the rear panel 18 is the same but the front panel 16 prime has a slightly shorter tab portion 26 prime with a first lower edge 28 prime. Instead of using a single horizontal crotch portion fastening tape 38 as in FIG. 1, a pair of horizontally spaced vertically extending fastening tapes 54 are used. These are mounted on the outside surface of panel 16 prime.

The long crotch portion 30 prime carries a front covering portion 50 which has the second lower edge 32 prime of crotch portion 30 prime. A pair of horizontally spaced vertically extending fastening tapes 52 are provided on the inside surface of cover portion 50 which can be pressed into engagement with tapes 54 on the outside surface of front panel 16 prime. In this way, a degree of vertical adjustment can be achieved to change the volume of the crotch area of the assembled brief as shown in FIG. 4. The solid line for edge 32 prime in FIG. 4 shows a larger volume area while the phantom line for edge 32 prime shows a smaller volume area.

Transition zones 46 prime, 48 prime, and 49 prime are similar to the transition zones of FIG. 1 but curve slightly differently to accommodate the different lengths for the crotch portions.

As noted above the brief 10 prime of FIGS. 3 and 4 is primarily suited for men.

In FIGS. 5 and 6 a brief generally designated 10″ is the same as the briefs shown in FIGS. 1 and 2 but is suited for pregnant women. The front panel is replaced by an elastic front panel portion 16″ which accommodates the larger abdomen of a pregnant woman.

In all of the embodiments, the long crotch portions 30 or 30′ can be lined with an extra layer of absorbant material such as cotton. The remainder of the brief except for the fasteners and waist band can also be made of cotton or other suitable material.

While specific embodiments of the invention have been shown and described in detail to illustrate the application of the principles of the invention, it will be understood that the invention may be embodied otherwise without departing from such principles.

What is claimed is:

1. A one-piece brief comprising:

An upper band portion having an upper horizontal edge, a front panel and a rear panel, said front panel having a first open vertical side edge and said rear panel having a second open vertical side edge;

A resilient waist band connected to and extending along said upper edge;

A short tab portion depending from a center of said front panel and having a first lower horizontal edge;

A long crotch portion depending from a center of said rear panel and having a second lower horizontal edge, said long crotch portion being longer than said short tab portion;

Vertical fastening tapes connected to and extending along said first and second side edges, said verticle fastening tapes engageable with each other to connect said first and second side edges together to close said upper band portion around a wearer;

Crotch portion fastening tapes connected to each of said tab and crotch portions, said crotch portion fastening tapes being engageable together to connect said tab portion to said crotch portion;

A first length of waist fastening tape connected to an end of said waist band at said first vertical side edge, said first length of waist fastening tape extending on said first vertical side edge;

A second length of waist fastening tape connected to an opposite end of said waist band adjacent to said second verticle side edge, said first length of waist fastening tape being engageable over said second length of waist fastening tape to align said vertical length of fastening tape with each other and for connecting opposite ends of said waist band.

2. A brief according to claim 1 wherein said crotch portion fastening tapes each comprised horizontal lengths of tapes connected to said first and second lower edges respectfully.

3. A brief according to claim 2 wherein said front and rear panels, said short tab portion and said long crotch portion all have an inner surface for facing the skin of a wearer and an outer surface for facing away from the wearer, said vertical length of fastening tape connected to said first side edge, said crotch fastening tape connected to said long crotch portion and said first length of waist fastening tape all being connected to said inner surface, said vertical length of fastening tape connected to said second vertical side edge, said second length of waist fastening tape and said crotch portion of fastening tape connected to said short tab portion all being connected to outer surfaces.

4. A brief according to claim 1 wherein said long crotch portion includes a front covering part, said crotch portion fastening tapes comprising a first pair of vertically extending horizontally spaced fastening tapes on said front panel and a second pair of vertically extending, horizontally spaced fastening tapes on said front covering portion, said first and second lower edges over lapping each other and said first and second pairs of fastening tapes overlapping each other by different amounts to change their volume of a crotch formed by said tab and crotch portions.

5. A brief according to claim 4 wherein said front and rear panels, said short tab portion and said long crotch portion all have an inner surface for facing the skin of a wearer and an outer surface for facing away from the wearer, said vertical length of fastening tape connected to said first side edge, said crotch fastening tape connected to said long crotch portion and said first length of waste fastening tape all being connected to said inner surface, said vertical length of fastening tape connected to said second vertical side edge, said second length of waist fastening tape and said crotch portion of fastening tape connected to said short tab portion all being connected to outer surfaces.

6. A brief accoring to claim 1 wherein said front panel includes an elastic area extending between said waist band and said first lower edge of said short tab portion.

7. A brief according to claim 6 wherein said front and rear panels, said short tab portion and said long crotch portion all have an inner surface for facing the skin of a wearer and an outer surface for facing away from the wearer, said vertical length of fastening tape connected to said first side edge, said crotch fastening tape connected to said long crotch portion and said first length of waist fastening tape all being connected to said inner surface, said vertical length of fastening tape connected to said second vertical side edge, said second length of waist fastening tape and said crotch portion of fastening tape connected to said short tab portion all being connected to outer surfaces.

8. A brief according to claim 1 wherein said fastening tape all comprise hook and pile fastening tapes.

9. A brief according to claim 8 including a layer of absorbant fabric on an inside surface of said long crotch portion.

10. A brief according to claim 9 wherein said front and rear panels, said short tab portion and said long crotch portion all have an inner surface for facing the skin of a wearer and an outer surface for facing away from the wearer, said vertical length of fastening tape connected to said first side edge, said crotch fastening tape connected to said long crotch portion and said first length of waist fastening tape all being connected to said inner surface, said vertical length of fastening tape connected to said second vertical side edge, said second length of waist fastening tape and said crotch portion of fastening tape connected to said short tab portion all being connected to outer surfaces.

* * * * *